United States Patent [19]

Katzke et al.

[11] 4,208,842

[45] Jun. 24, 1980

[54] DUAL SURFACE LAPPING MACHINE

[75] Inventors: Ernest F. Katzke, Des Plaines; Dennis E. Lindquist, Rockford, both of Ill.

[73] Assignee: Crane Packing Co., Morton Grove, Ill.

[21] Appl. No.: 914,977

[22] Filed: Jun. 12, 1978

[51] Int. Cl.[2] ..... B24B 7/06; B24B 53/02

[52] U.S. Cl. ..... 51/111 R; 51/117; 51/118; 51/133; 125/11 DF

[58] Field of Search ..... 51/109 R, 111 R, 117, 51/118, 129, 131.1, 131.2, 131.3, 131.4, 131.5, 133, 5 D; 125/11 DF

[56] References Cited

U.S. PATENT DOCUMENTS

| | | | |
|---|---|---|---|
| 1,508,378 | 9/1924 | Brown | 51/109 R |
| 1,926,779 | 9/1933 | Law | 51/122 |
| 2,747,338 | 5/1956 | Hoare | 51/118 |
| 3,000,148 | 9/1961 | Bouensiepen | 125/11 DF |
| 3,872,626 | 3/1975 | White | 51/129 R |
| 4,007,560 | 2/1977 | Janssen | 51/111 R |

FOREIGN PATENT DOCUMENTS

| | | | |
|---|---|---|---|
| 189275 | 9/1907 | Fed. Rep. of Germany | 51/131 B |
| 770604 | 3/1957 | United Kingdom | 51/111 R |

*Primary Examiner*—Frank T. Yost
*Assistant Examiner*—K. Bradford Adolphson
*Attorney, Agent, or Firm*—Dorsey L. Baker

[57] ABSTRACT

This specification discloses a Dual Surface Lapping Machine having at least one fixed lower spindle and an upper spindle carried by an A-frame mounted on guide ways. The spindles and guide ways are parallel to one another to permit accurate lapping of piece parts and to facilitate dressing of the lapping surfaces. The upper spindle is mounted in self aligning bearing means which permits floating movement of the upper lapping surface upon work pieces of different thicknesses. To provide accurate dressing of the lapping surfaces locking means are provided to lock the self-aligning bearing. Each spindle is adapted to receive a dressing tool so as to accommodate accurate dressing of the surfaces in a manner eliminating bending deflections associated with prior art devices.

8 Claims, 7 Drawing Figures

DUAL SURFACE LAPPING MACHINE

BACKGROUND OF THE INVENTION

The present invention relates to a Dual Surface Lapping Machine having at least two spindles. More particularly, the invention relates to a lapping machine which eliminates conventional cantilevered dressing tools and the cantilever supported upper spindle. In the preferred embodiment, the invention is embodied in a three spindle machine.

Conventional three spindle lapping machines are designed with two lower spindles and an upper spindle pivotally mounted in cantilever fashion from an upstanding vertical post. Such permits dual lapping on one of the spindles while the operator is loading the other lower spindle with raw work pieces. Upon completion of the lapping of the work piece on the first spindle, the upper spindle is then positioned over the second lower spindle while the finished parts are removed and the first spindle is reloaded. Occasionally, the lapping operation must be interrupted to dress the lapping surfaces. For this purpose, conventional lapping machines utilize expensive dressing attachments which mount a dressing tool in cantilever fashion and require drive motors to move the tool across the surfaces.

In view of the large masses and forces which are mounted and exerted in cantilevered fashion, both the upper spindle and the dressing arms are subject to bending deflections and wear.

SUMMARY OF THE INVENTION

To overcome these disadvantages, the present invention is a novel lapping machine having a machine bed or base which supports at least one and preferably two lower spindles. Guide ways on opposite sides of the bed support an A-frame for horizontal sliding movement. Mounted within the A-frame is an upper spindle. The A-frame is provided with a power device which effects sliding action of the A-frame and upper spindle along the guide ways. During normal dual surface lapping, this power device is used to alternate the A-frame between positions of vertical alignment with each of the lower spindles. Preferably the upper spindle is mounted within a self aligning bearing to permit floating adjustment of the upper lapping surface on the raw piece parts.

Each of the spindles is provided with means for mounting a dressing tool to facilitate dressing of the lapping surfaces. For this purpose, the self aligning bearing of the upper spindle is provided with locking means to preclude its floating action. With this spindle locked and carrying a dressing tool, the power means slowly drives the A-frame, spindle and dressing tool across each of the lower lapping surfaces to effect dressing. To dress the upper lapping surface, a dressing tool is mounted on one of the lower spindles to engage the upper lapping surface. The A-frame and upper spindle is again slowly translated to effect dressing of the upper surface.

The objects of these novel combinations is to provide a lapping machine with one or more of the following features and advantages:

1. Accurate dressing of the lapping surfaces by rigid mounting of the tool directly upon the spindle;

2. Elimination of cantilever support for the upper spindle;

3. Power drive means for alternating the upper spindle between positions of vertical alignment with the lower spindles and for moving the lapping surfaces across a dressing tool;

4. Greater stability and down pressure upon the work pieces during lapping by appropriate mounting of the upper spindle.

BRIEF DESCRIPTION OF THE DRAWINGS

The manner in which these and other objects are accomplished is disclosed in the following specifications and drawings in which.

DETAILED DESCRIPTION OF THE PREFERRED EMBODIMENT

Figure 1:
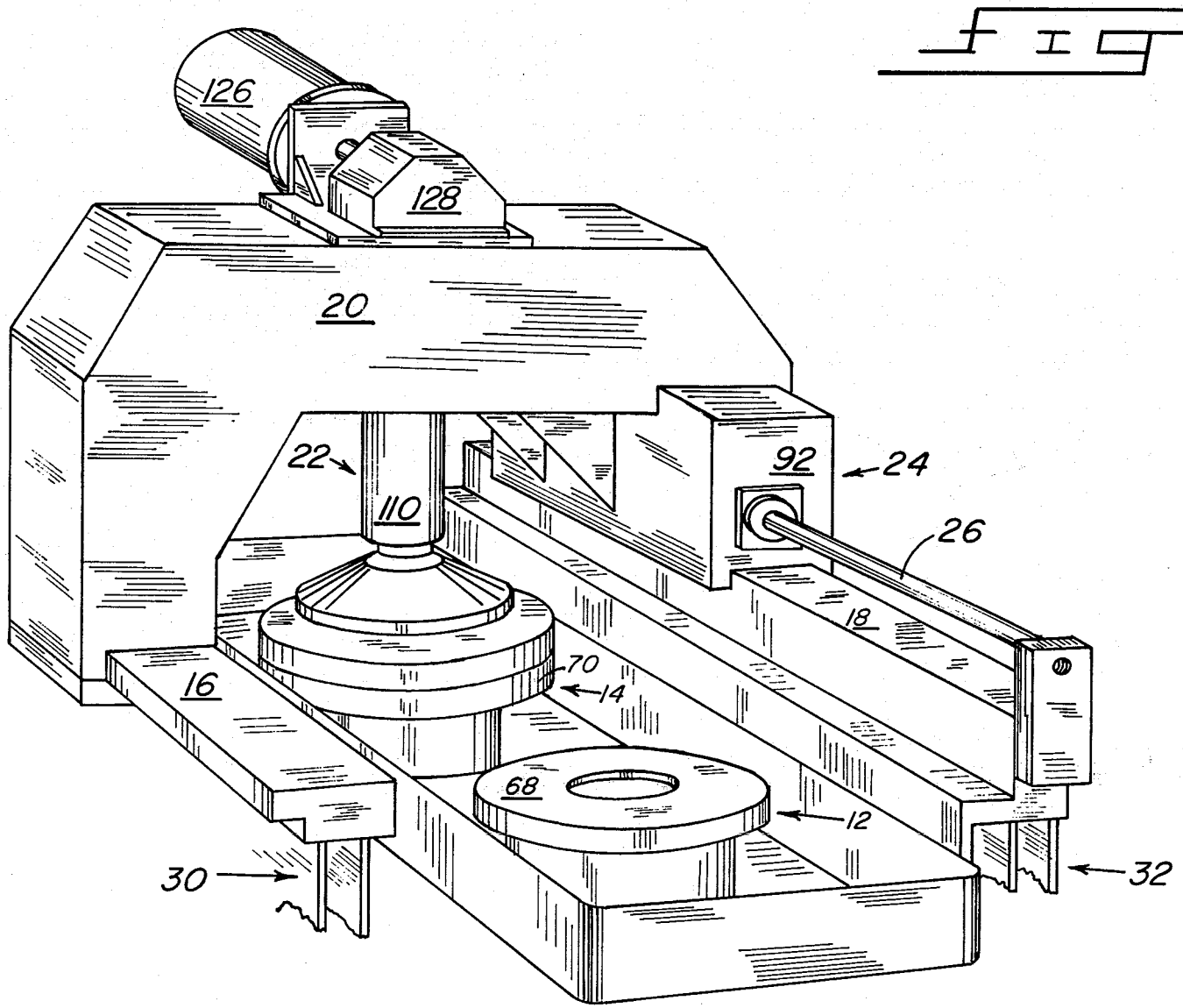
FIG. 1 is a partial perspective view of a preferred embodiment of our invention.
Figure 2:
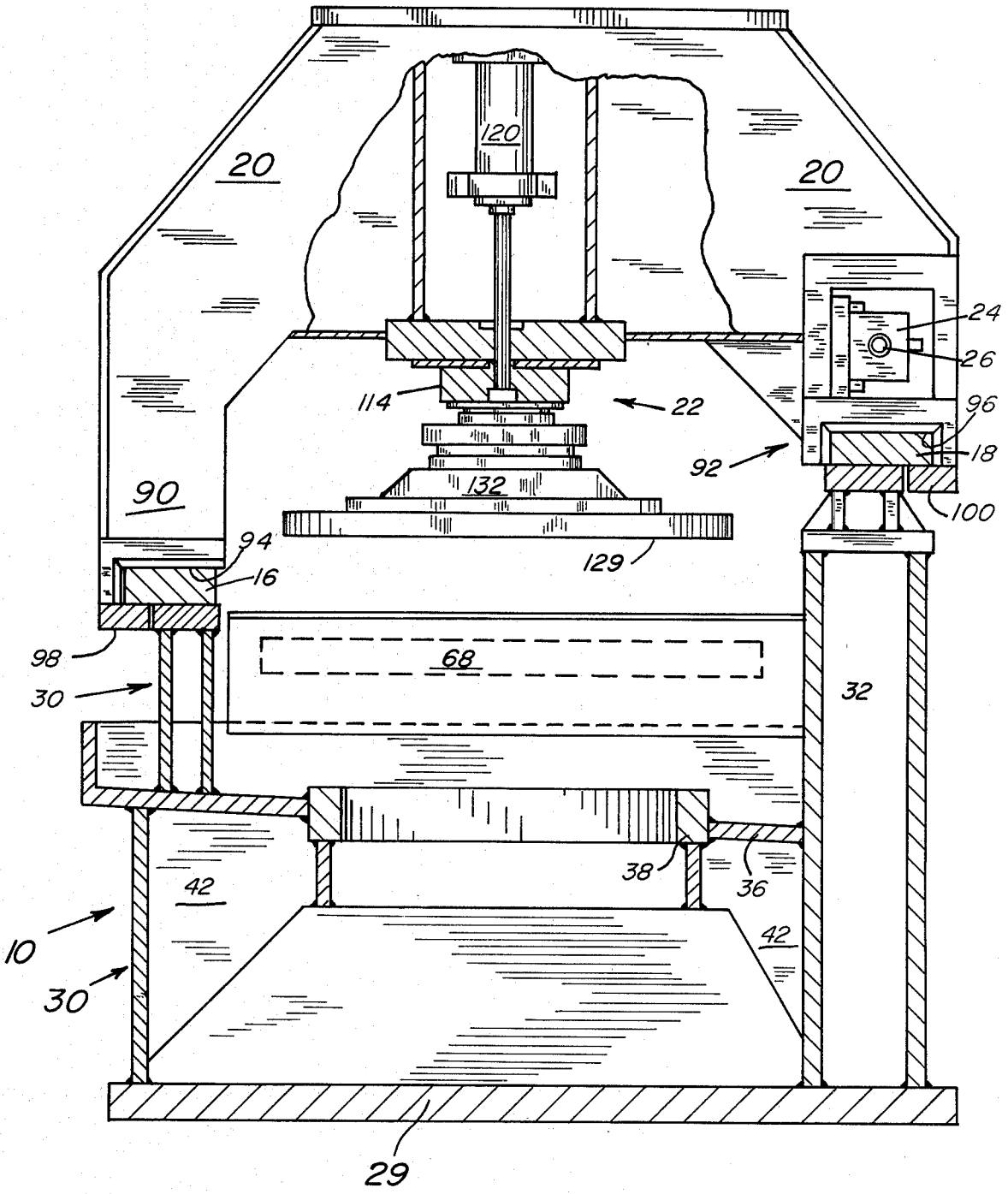
FIG. 2 is a side elevation view, partially in section of the embodiment of FIG. 1.

The general features of the preferred embodiment of our invention are depicted in FIGS. 1 and 2. This embodiment includes a machine bed 10 which mounts two lower spindle units 12 and 14. On opposite sides of the bed 10 are guide ways 16 and 18 which support an A-frame 20 for horizontal sliding movement. Mounted within the A-frame 20 is the upper spindle unit 22. This upper unit 22 is alternatively placed into vertical alignment with each of the lower spindle units by sliding the A-frame 20 along guide ways 16 and 18. This sliding movement of the A-frame 20 and upper spindle unit 22 is effected, preferably, by a hydraulic motor unit 24 which comprises a piston rod 26 having a fixed piston positioned within a hydraulic chamber of A-frame 20.

During normal lapping operations, piece parts to be lapped are placed upon one of the lower spindle units such as 12. The A-frame is then driven along vertical guide ways to a position such that spindle unit 22 is vertically aligned with spindle unit 12. When that vertical alignment is obtained, the upper spindle is lowered and down pressure is applied (by means subsequently disclosed). Both surfaces of the piece parts are then lapped through rotary motion of lapping surfaces driven by motors associated with each of the spindle units 12 and 22. During this lapping operation, the machine operator can unload finished piece parts from spindle unit 14 and reload that spindle unit with unfinished piece parts. When the parts on spindle 12 are lapped, the upper spindle unit 22 is raised and then reciprocated by motor unit 24 into vertical alignment with spindle unit 14 for lapping piece parts on that spindle.

A lapping machine of this configuration presents substantial problems to the designer. First, accurate vertical alignment of the upper and lower spindles must be designed into the machine and then maintained during lapping. In addition, dual surface lapping requires means for obtaining down pressure on the upper spindle. The requirement for down pressure appears inconsistent with the requirement of horizontal sliding action.

Consideration of the details of the machine will reveal how these design inconsistencies are overcome. First, the machine bed or base, which may take various configurations, is provided with a base plate 29 from which extends vertical support structures, 30, 32, on each side. These vertical supports mount master guide ways 16 and 18 in a manner which avoids their vertical deflection under the weight of A-frame 20. Preferably, these guide ways are hand scraped to make them perfectly flat with their upper surfaces being parallel to each other.

The bed 10 is also provided with a sloping drainage table 36. The lapping compound falls to this table and is drained away by conventional conduits to a sump. In this preferred embodiment the drain table 36 is cut out to receive two annular mounting flanges 38, 40 for receiving the lower spindle units 12 and 14. Since these units are heavy and must be rigidly supported, a web reinforcing structure 42 is interposed between the base 29, vertical supports 30, 32 and the mounting rings 38, 40 carried by drain table 36.

The upper surfaces 39 and 41 of the annular mounting rings 38, 40 are also hand scraped so as to be flat and parallel with the guide ways 16 and 18.

Figure 4:
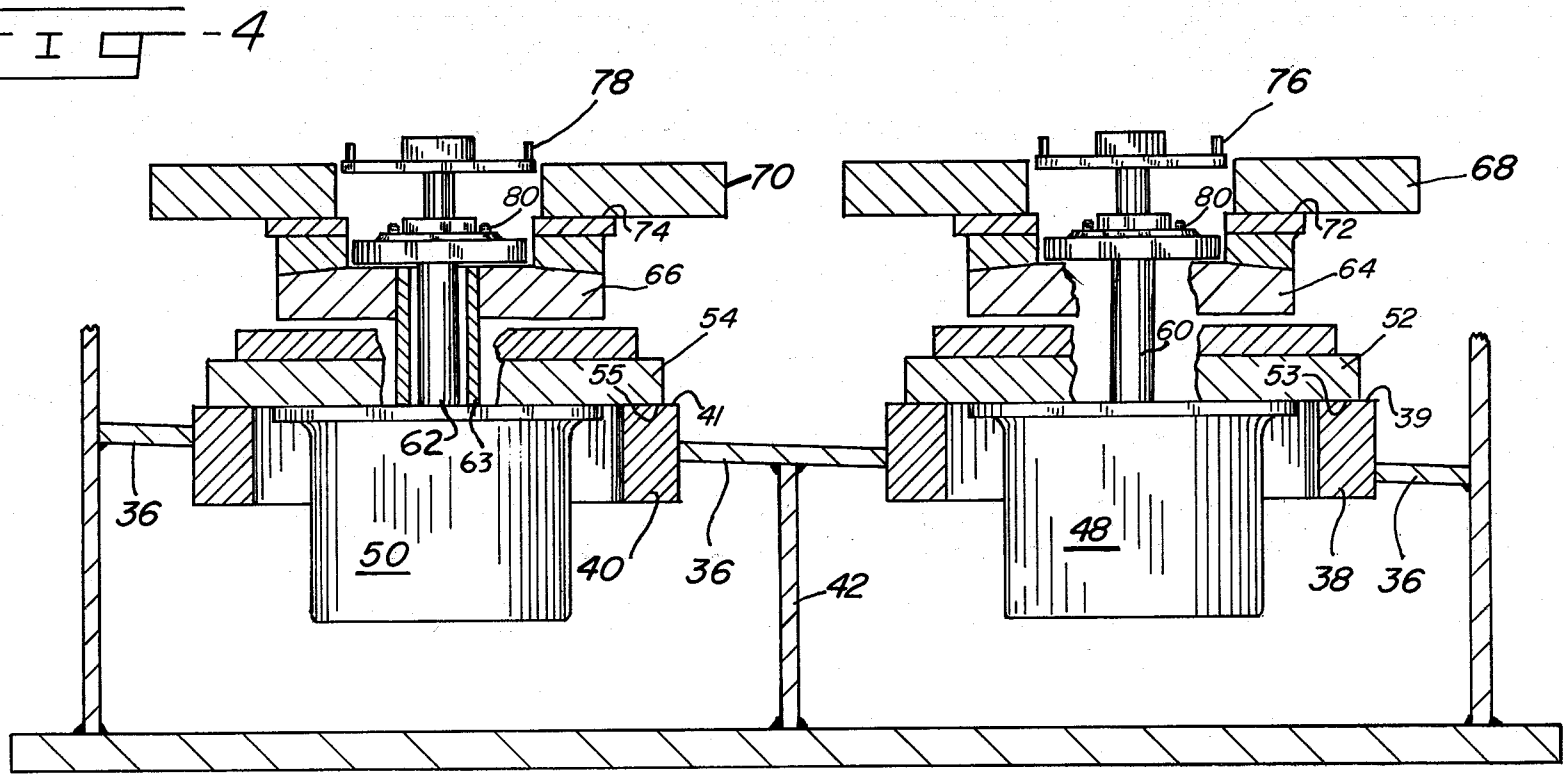
FIG. 4 is a front elevation view taken along the lines 4—4 of the embodiment of FIG. 2.

After the surfaces of the annular mounting rings are prepared, spindle units 12, 14 (see FIG. 4) are installed therein. These spindle units comprise gear boxes 48 and 50 and associated rotary drive means (not shown). Each spindle unit is provided with a radially extending flange 52, 54 having lower surfaces 53, 55 which are also hand scraped to insure that each unit is mounted perpendicular to the parallel surfaces of guide ways 16 and 18.

Each of the gear boxes has a quill type drive shaft 63 (only one of which is shown) which transmit rotary motion through drive plates 64, 66 to the lapping plates 68, 70 in a conventional fashion. To insure that the lapping plates 68, 70 rotate parallel with each other, the upper surfaces 72, 74 of drive plates are hand scraped to provide parallel planar surfaces. Each gear box 48, 50 also drives inner spindles 60 and 62 which transmit rotary motion to peg rings 76, 78 by bolts 80. These peg rings drive work piece holders against the outer peg rings (not shown) in a well known manner. Such holders conventionally take the form of plates havng cavities to receive the raw work pieces and gear teeth on their external diameter meshing with the peg rings.

The above description includes a broad disclosure of combination used in construction of a preferred embodiment of machine bed according to our invention. Detail items which are conventional and within the skill of the art such as the motor drives, fluid pumps, etc. have been omitted to facilitate a clearer disclosure of our invention.

Straddling the machine bed 10 is the A-frame 20. Each leg 90, 92 of the A-frame is supported upon the guide ways 16, 18 and has a sufficient depth to provide vertical stability when positioned upon the guide ways. Their supporting surfaces 94, 96 are also hand scraped to insure that the upper spindle, when locked in its rigid position, is perpendicular to the guide way surfaces 16 and 18. Gibs 98, 100 are affixed to the legs, 90, 92 of A-frame 20. These gibs extend under the guide ways 16, 18 to permit the application of down pressure against the lower lapping units. With this construction, the A-frame can be reciprocated along guide ways 16, 18 by a hydraulic or other drive 24.

Figure 3:
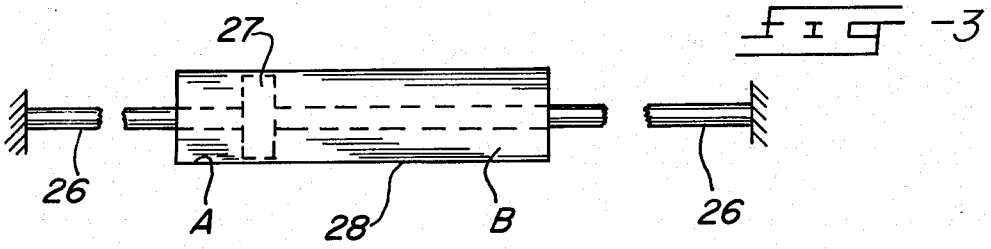
FIG. 3 is a schematic view depicting a preferred embodiment of the power translating means for the upper spindle.

As shown in FIG. 3, this drive includes a fixed piston rod 26 mounting a piston 27 thereon. This piston rod extends through a chamber 28 affixed to or within the A-frame 20. The piston 27 divides chamber into two pressure chambers A and B such that fluid pressure directed to either chamber will reciprocate the A-frame along guide ways 16, 18.

Figure 5:
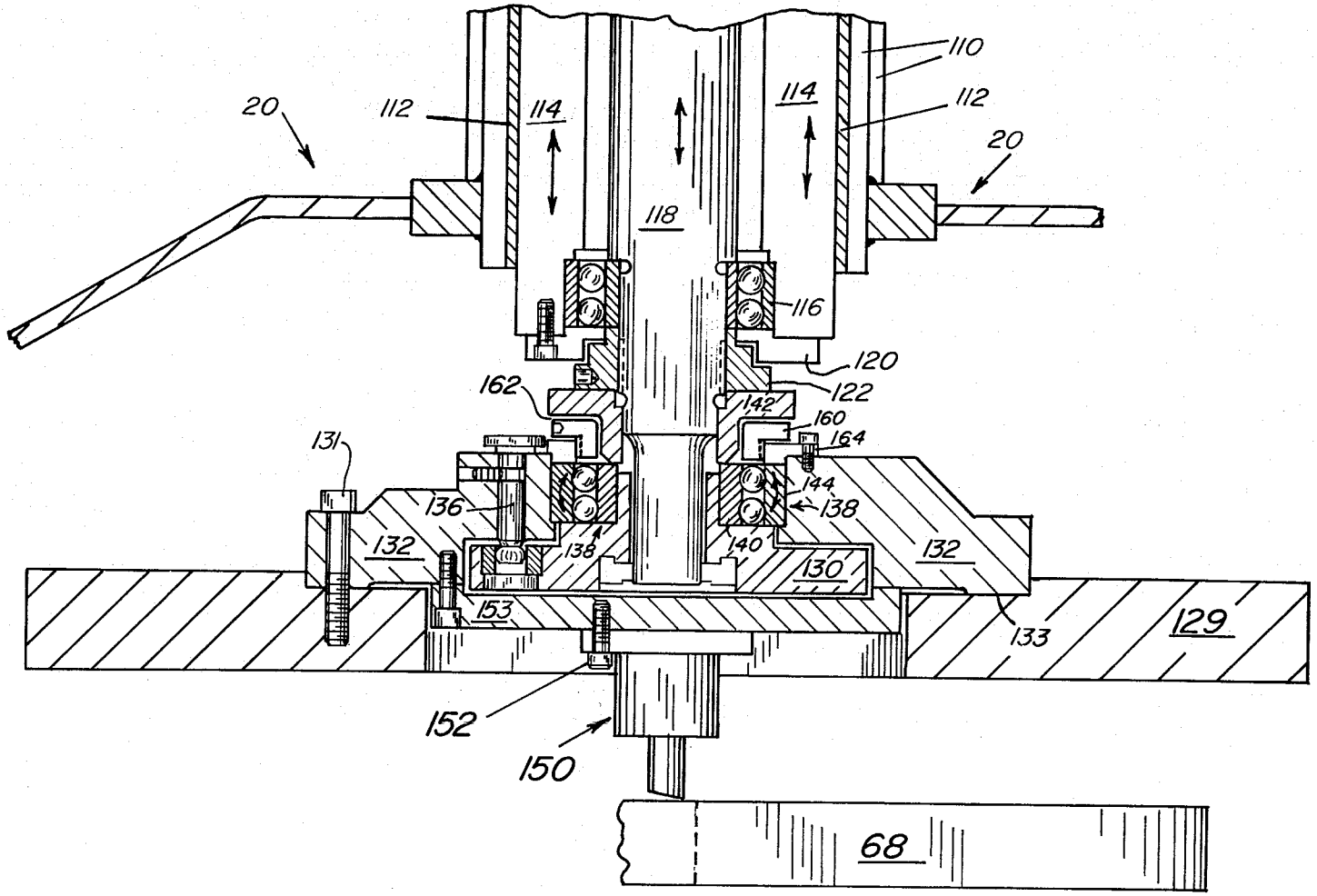
FIG. 5 is a front elevation view taken along the lines 5—5 of FIG. 2.

Mounted within the bridge of the A-frame 20 is the upper spindle unit 22. FIG. 5 discloses a preferred construction and mounting of this unit. External support tubes 110 are welded or otherwise affixed to structural portions of the A-frame 20. Within the support tubes is, preferably, a bronze wear liner 112 which receives a vertically reciprocable quill shaft 114. Journaled within this quill shaft 114 by antifriction bearings 116 (only one of which is shown) is the upper spindle shaft 118. A flange 120 and lock nut 122 fix the spindle shaft 118 against vertical movement relative to quill shaft 114 and bearing 116.

The spindle shaft 118 is rotated by a motor 126 (FIG. 1) through a gear box 128 mounted on top of the A-frame in a conventional manner. To effect lapping of the top surfaces of the work pieces, this rotary motion of the spindle 118 must be transferred to the upper lapping ring 129. For this purpose the bottom end of the spindle shaft 118 is splined to receive an internally splined driving collar 130. A lapping ring drive plate 132 is placed on top of the collar 130 and mounts the lapping plate 129 through bolts 131 as shown in FIG. 5. Preferably, the drive plate 132 is constrained for rotation with the splined collar 130 and spindle 118 through a shear pin 136. Between the collar 130 and drive plate 132 is a self-aligning 138 which permits floating action of the drive plate 132 and the associated lapping plate 129 during normal lapping. With such flotation, the plate 129 is free to adjust itself to the top surface of three of the work pieces when lapping is commenced. Thus only the inner race 140 of bearing is rigidly locked in place between a collar 142 and the drive plate 130. The outer race 144 encapsulated between an annular flange 164 and drive plate 130, is nevertheless free to float as shown by arrows in FIG. 5. This floating action of lapping plate 129 and outer race 144 is permitted by a clearance 162 between the upper surface of lock nut 160 and collar 142 which abuts lock nut 122.

Such floating of the upper lapping plate 129 and drive collar 130 is not always desirable. In accordance with our invention, provision is made for affixing a dressing tool 150 by bolts 152 to a plate 153 affixed to drive plate 132 of the upper spindle. This tool extends downward to dress the lower lapping plates 68, 70 as the A-frame is slowly traversed across the lower ring. With the upper spindle drive collar 160 rigidly locked, the lower rings can be dressed to a very high degree of accuracy.

When dressing is desired, the lock nut 160, threadedly engaged with annular flange 164, is screwed upward to abut the collar 142, eliminating clearance 162 and locking outer race 144 against floating. When locked, the drive plate 153 provides rigid support for dressing tool 150. Such avoids the prior art cantilevered design for dressing tools.

To vertically position the upper lapping plate for lapping; to apply down pressure during lapping; and to vertically position the dressing tool, when used, a hydraulic ram 120 is interposed between A-frame 20 and the quill shaft 114. Such permits accurate vertical positioning of the upper lapping surface.

Figure 6:
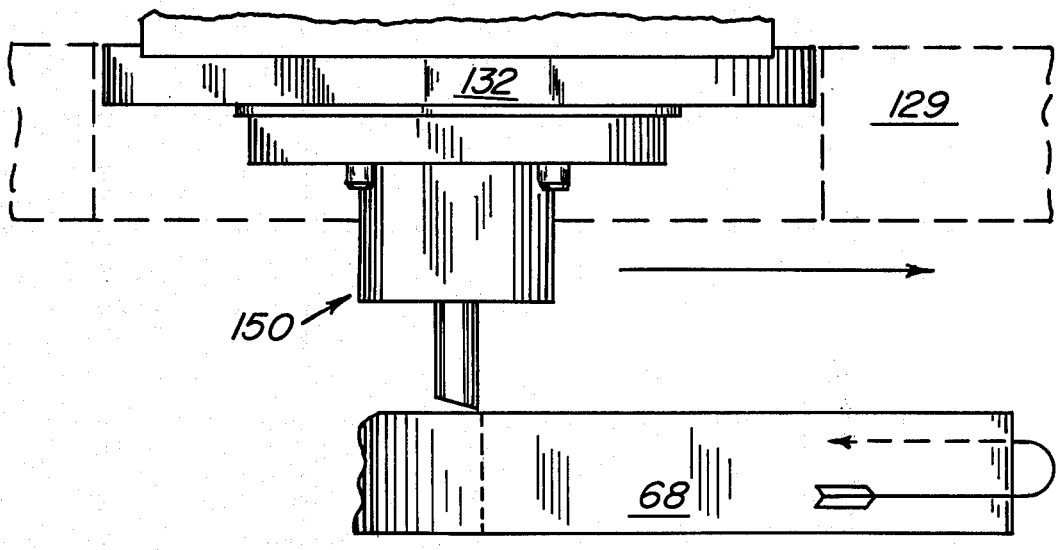
FIGS. 6 and 7 are side elevation views depicting the method of dressing the lower and upper lapping surfaces.
Figure 7:
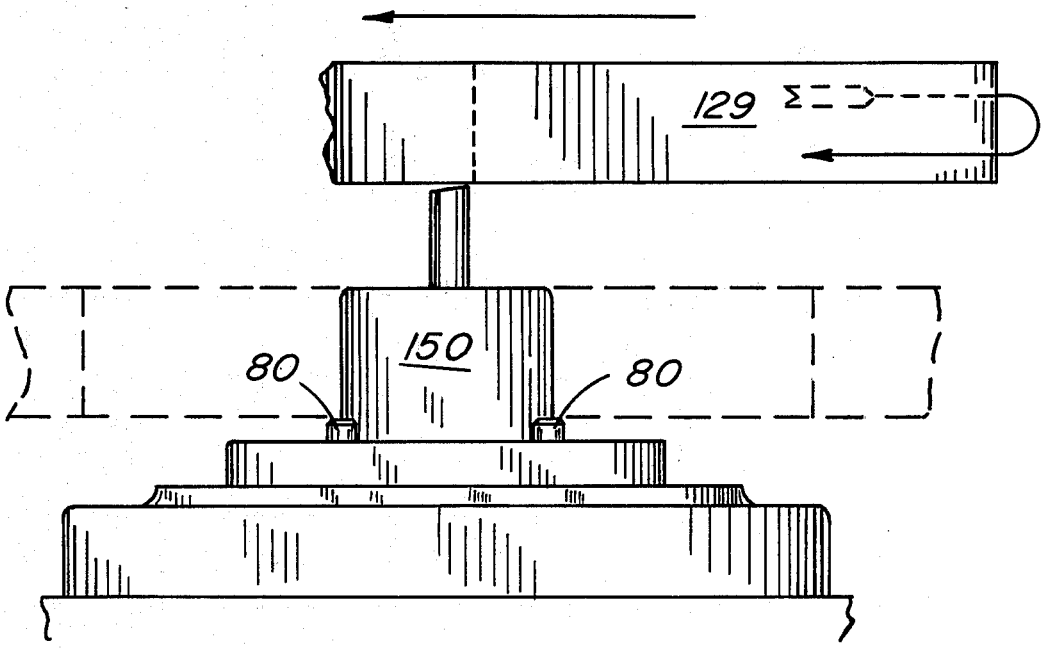

The benefits of this design in terms of accurate dressing of the lapping surfaces can be best understood by referring to FIGS. 6 and 7. In FIG. 6, the dressing tool has been attached to the drive plate 132 of the upper spindle 118. This spindle, quill shaft 114 and tool 150 are then lowered into a position to dress the lower lapping plate. With the upper spindle 118 locked against flotation by lock nut 160 and against rotation, the lower spindle is then rotated as the A-frame is slowly traversed across lapping plate 68 by motor drive 24. The tool 150, being rigidly held in place, avoids the bending deflections of prior art cantilevered systems. Similarly, to dress the upper lapping plate 129, the peg ring 76 of one of the lower spindle units is removed and replaced with a dressing tool 150.

With the upper spindle being lowered to a dressing position as shown in FIG. 7, and locked against flotation, the upper ring 129 is dressed as it is rotated by motor 126 and reciprocated with the A-frame 20.

Accordingly, the structure here proffered provides the advantages and objects previously suggested. The use of the reciprocal A-frame and other structure disclosed permits very accurate lapping and dressing while avoiding the bending deflections of the prior art cantilevered systems. Such accuracy can be obtained by supporting structure which insures that the upper surfaces 72, 74 of the lower lapping drive plate lie in parallel planes. Similarly, the lower surface 133 of upper drive plate should also lie in a plane parallel to the planes of surfaces 72 and 74 when locked against flotation. This parallelity is of considerable importance, and the supporting hand scraped surfaces may be varied or repositioned as long as this planar relation is maintained. The spindle units 12, 14 and 22 may incorporate various other features and modifications well known to those skilled in the art.

We claim:

1. A dual surface lapping machine comprising:

(a) a machine bed;

(b) parallel linear guide ways mounted on opposite sides of said machine bed;

(c) at least one lower spindle unit mounted in said bed, said at least one lower spindle unit having a lapping ring drive plate and a lapping plate mounted thereon;

(d) frame means supported upon said parallel linear guide ways and being translatable thereon;

(e) an upper spindle unit mounted in said frame means, said upper spindle unit having a lapping ring drive plate and a lapping plate mounted thereon;

(f) a dressing tool;

(g) said drive plates having surfaces which lie in parallel planes and include means for mounting said dressing tool for dressing the lapping plates of the opposite spindle unit; and (h) means for effecting straight line translatable movement of said frame means and upper spindle unit along said guide ways.

2. An apparatus as recited in claim 1 in which said means for effecting translatable movement is a hydraulic piston and chamber interconnected between said machine bed and said frame means.

3. An apparatus as recited in claim 1 in which said frame is provided with means for applying down pressure to said upper spindle.

4. An apparatus as recited in claim 1 in which the upper spindle unit has means for permitting flotation of the upper lapping plate.

5. A Dual Surface Lapping Machine comprising:

(a) A base having two transversely disposed support members for receiving two spindle units and having horizontal linear guide ways thereon;

(b) Two lower spindle units mounted in said support members, said units having drive plates supporting lapping plates thereon;

(c) Said spindle units and support members having mating surfaces lying in planes parallel to the planes of said ways for supporting the spindles perpindicular thereto and for supporting the surface of said drive plates of said spindles parallel to one another;

(d) A frame slidably mounted on said ways;

(e) An upper spindle unit mounted in said frame and having a lapping surface for cooperating with said spindle units of said base for lapping piece parts;

(f) One of said lower spindle units and said upper spindle unit adapted to receive a dressing tool;

(g) Power means for alternatively translating said frame and upper spindle into vertical alignment with said lower spindle units and for translating said frame and upper spindle unit relative to said lower spindle unit for dressing the lapping plates when a dressing tool is mounted on one of said spindles.

6. An apparatus as recited in claim 5 in which said upper spindle has a drive plate for mounting a lapping ring, said drive plate having a flat surface which may be fixed in a plane parallel to the plane of supporting surfaces of the lower drive plates.

7. An apparatus as recited in claim 5 in which said upper spindle unit is provided with means allowing flotation of its associated lapping plate.

8. An apparatus as recited in claim 5 in which said machine is provided with means for applying down pressure to said upper lapping plate.

* * * * *